US006849583B2

(12) United States Patent
Corr et al.

(10) Patent No.: US 6,849,583 B2
(45) Date of Patent: Feb. 1, 2005

(54) LUBRICANT COMPOSITIONS

(75) Inventors: Stuart Corr, Warrington (GB); Steven James Randles, Middlesbrough (GB); Peter Timothy Gibb, Guisborough (GB)

(73) Assignee: Imperial Chemical Industries Plc, London (GB)

( * ) Notice: Subject to any disclaimer, the term of this patent is extended or adjusted under 35 U.S.C. 154(b) by 0 days.

(21) Appl. No.: 09/912,316

(22) Filed: Jul. 26, 2001

(65) Prior Publication Data

US 2002/0013233 A1 Jan. 31, 2002

Related U.S. Application Data

(63) Continuation of application No. PCT/GB00/00220, filed on Jan. 26, 2000.

(30) Foreign Application Priority Data

Jan. 26, 1999 (GB) ..... 9901667

(51) Int. Cl.[7] ..... C10M 105/38; C10M 107/34; C09K 5/04

(52) U.S. Cl. ..... 508/405; 508/409; 508/469; 508/474; 508/485; 508/501; 508/504; 508/579; 508/582; 252/68

(58) Field of Search ..... 508/485, 405, 508/504

(56) References Cited

U.S. PATENT DOCUMENTS

| | | | | | |
|---|---|---|---|---|---|
| 4,556,496 | A | | 12/1985 | Glova | 508/405 |
| 4,755,316 | A | * | 7/1988 | Magid et al. | 252/68 |
| 4,851,144 | A | * | 7/1989 | McGraw et al. | 252/68 |
| 4,948,525 | A | * | 8/1990 | Sasaki et al. | 252/68 |
| 5,595,678 | A | * | 1/1997 | Short et al. | 252/68 |
| 5,711,896 | A | * | 1/1998 | Kaimai | 252/68 |
| 5,792,383 | A | * | 8/1998 | Reyes-Gavilan et al. | 508/504 |
| 5,866,030 | A | | 2/1999 | Reyes-Gavilan et al. | |
| 5,906,769 | A | * | 5/1999 | Schnur et al. | 252/68 |
| 5,976,399 | A | * | 11/1999 | Schnur | 252/68 |
| 6,127,324 | A | * | 10/2000 | Tolfa et al. | 508/463 |
| 6,410,492 | B1 | * | 6/2002 | Shimomura et al. | 508/485 |

FOREIGN PATENT DOCUMENTS

| | | |
|---|---|---|
| EP | 0913457 A2 | 5/1999 |
| WO | 9607721 | 3/1996 |
| WO | 9936485 | 7/1999 |

* cited by examiner

*Primary Examiner*—Ellen M. McAvoy
(74) *Attorney, Agent, or Firm*—Pillsbury Winthrop LLP

(57) ABSTRACT

A lubricant composition containing an anti-deposition component having an anti-deposition effect which is especially useful for the lubrication of refrigeration compressors and in reducing or removal of unwanted deposits in constricted areas in a refrigeration system.

12 Claims, No Drawings

LUBRICANT COMPOSITIONS

CROSS REFERENCE TO RELATED APPLICATION

This application is a continuation of International Application PCT/GB00/00220, filed Jan. 26, 2000, which designated the United States and was published in the English language. This application, in its entirety, is incorporated herein by reference.

This invention relates to a lubricant composition and in particular to a lubricant composition having an anti-deposition effect which is especially useful for the lubrication of refrigeration compressors. The invention also relates to a refrigeration system containing a refrigerant and a lubricant composition and to the use of the lubricant composition and a method of inhibiting or removing unwanted residues.

Conventional refrigeration systems typically have a compressor, a condenser, an expansion device and an evaporator linked to form a loop in which a refrigerant circulates and is successively condensed and evaporated so as to provide a refrigeration effect. Various types of compressor are employed in refrigeration systems including reciprocating, scroll, rotary and screw compressors and are selected according to the particular application. The compressor contains moving parts which are lubricated during use. The expansion device in refrigeration systems generally contains an area of constricted flow of refrigerant and may be, for example a capillary tube or an expansion valve.

A range of different materials are used in the construction of the components of a refrigeration system including metals and plastics materials. Other materials such as oils may be used in the assembly of the hardware of such systems and the components of the refrigerant working fluid especially additives may be susceptible to thermal or hydrolytic decomposition. During use and through wear, some of these materials may be present in the refrigeration loop and be carried around the system by the flow of refrigerant as unwanted residues. Other unwanted residues may also be introduced through servicing or the repair of refrigeration systems or in retrofilling new refrigerant or lubricant to the system once it has been used. In particular plastics materials, paraffinic materials, poly-alpha-olefins, silicone oils and carbonaceous materials especially high molecular weight and non polar materials may be found as unwanted residues in the refrigeration loop. Such materials may be deposited in the refrigeration system especially in areas of constriction, and cause blockages and trap additional materials, for example particulate matter. Deterioration in performance and in extreme cases, system failure may occur due to such blockages.

In general, there are two types of refrigeration system, first, systems in which the lubricant and refrigerant are present as a mixture and circulate around the refrigeration system as such, for example in automotive refrigeration systems, and secondly, systems in which the refrigerant circulates in the system and the lubricant is present in a sump in the compressor, for example open and closed hermetic compressors and so-called industrial and commercial refrigerators. In the second case the system is designed to avoid or at least minimise the lubricant being carried from the compressor sump into the refrigeration loop although in practice, this typically occurs to a certain extent due to the entrainment of the lubricant into the refrigerant gas. Once lubricant is carried into the refrigeration loop it is necessary that it be transported around the system and deposited back in the sump otherwise reduced refrigeration effectiveness may result and problems due to a reduced level of lubricant in the sump may be encountered.

For many years, chlorofluorocarbons, for example dichlorodifluoromethane (R-12), have been used as refrigerants but have been implicated in the destruction of the ozone layer. Following the Montreal Protocol of 1987, such materials are being phased out and are being replaced by hydrochlorofluorocarbons on a temporary basis and also by hydrofluorocarbons. In particular, 1,1,1,2-tetrafluoroethane (R-134a) has found widespread use as a replacement refrigerant for R-12. HFC and HCFC refrigerants both containing hydrogen are generally more polar than the chlorofluorocarbon refrigerants. This has exacerbated problems caused by the presence of unwanted residues in refrigeration systems, especially when HFC refrigerants are employed, as such materials typically have lower solubility in polar refrigerants than in CFC refrigerants.

The problem of blockage due to the presence of foreign bodies in the recirculating refrigerant has hitherto been addressed by modifying the mechanical design of the expansion device, for example capillary tubes in which the cooler part of the device has a larger diameter so as to reduce the likelihood of deposition of foreign bodies. Attempts have also been made to reduce the level of foreign bodies which may be incorporated into the system during manufacture. Refrigeration systems having hermetic compressors may be especially prone to these problems due to the level of foreign material present in the compressor motor. These approaches have the general drawback of requiring evaluation and testing of the refrigeration system as new materials of construction may need to be employed and have met with only limited success.

We have now found that by incorporating a component having an anti-deposition effect into the refrigeration system, problems associated with the presence of unwanted residues such as capillary blockage may be reduced or avoided. Further, we have found that a component having amphiphilic properties provides a suitable anti-deposition effect.

Accordingly a first aspect of the invention provides a refrigeration lubricant composition comprising a lubricant and an amphiphilic anti-deposition component.

A second aspect of the invention comprises a refrigeration lubricant composition for use in a refrigeration system with a hydrogen-containing refrigerant comprising a synthetic lubricant and an amphiphilic anti-deposition component.

We have found that compositions according to the invention enhance the transport characteristics of unwanted residues, and so reduce deposition and/or aid removal of deposits for example by solubilising or dispersing the residues in the flow of the refrigerant and lubricant around the refrigeration system.

The refrigerant is suitably a hydrofluorocarbon (HCFC) refrigerant, a hydrofluorocarbon (HFC) refrigerant, or a blend of refrigerants containing at least one HFC, HCFC or both. The invention however has applicability in refrigeration systems containing other refrigerants including carbon dioxide and ammonia optionally in combination with one or more other refrigerant. Suitably the refrigerant does not contain chlorine atoms, thus the refrigerant is preferably consists essentially of only HFC refrigerant. HCFC's and HFC's contain at least one atom of carbon and fluorine and, in the case of HCFC's only, one or more chlorine atoms.

Examples of HCFC's include chloro difluoromethane (R22) and dichloro trifluoro ethane (R123).

Examples of HFC's include 1,1,1,2-tetrafluoroethane (R134a), 1,1,1,2,2-pentafluoroethane (R125), difluoromethane (R-32), 1,1,1-trifluoroethane (R143a) and 1,1-difluoroethane (R-152a). Other components typically found in refrigerant blends may also be included including hydrocarbons, especially hydrocarbons having from 1 to 6 carbon atoms for example propane, isobutane, butane and pentane, fluorinated hydrocarbons and other refrigerants, for example carbon dioxide.

When the refrigerant comprises a HFC and especially when the refrigerant consists essentially of a HFC, problems due to blockage of the refrigeration system and in particular the expansion device may be exacerbated.

The present invention is accordingly especially beneficial when the refrigerant comprises an HFC, for example 1,1,1,2-tetrafluoroethane (R134a) or blends of HFC's, for example R407C, R410A and R404A.

Various synthetic lubricants are known for use in refrigeration systems for example, polyalkylene glycols (PAGs) and polyol esters. These lubricants are typically used with HFC refrigerants and have a relatively high polarity. The problem of deposition of unwanted residues may also be exacerbated by the use of such lubricants.

Unwanted residues are often non-polar or of high molecular weight, whereas refrigerants comprising HFC's are generally of relatively high polarity and as a consequence the unwanted residue may not be easily solubilised or dispersed in the flow of refrigerant and lubricant.

A further aspect of the invention provides a refrigeration lubricant composition for use in a refrigeration system with a refrigerant comprising a hydrofluorocarbon which comprises a synthetic lubricant comprising a polyol ester and/or a polyalkylene glycol and an amphiphilic anti-deposition component.

The invention further comprises a refrigeration system comprising a compressor, a condenser, an expansion device and an evaporator linked to form a loop in which a refrigerant circulates and is successively condensed and evaporated so as to provide a refrigeration effect the refrigerant comprising a hydrofluorocarbon and/or a hydrochlorofluorocarbon refrigerant, and the system further containing a synthetic lubricant selected from a polyol ester and a polyoxyalkylene glycol and an amphiphilic anti-deposition component.

The invention also provides for the use of a lubricant composition comprising a lubricant and an amphiphilic anti-deposition component in a refrigeration system for the inhibition of deposition of deposits which adversely affect the performance of the refrigeration system.

In a further aspect the invention provides a method of inhibiting the deposition of or removing unwanted residues in a refrigeration system which comprises operating a refrigeration system when charged with a hydrogen-containing refrigerant and a lubricant composition comprising a lubricant and an amphiphilic anti-deposition component.

In yet a further aspect of the invention the anti-deposition agent is added to a refrigeration system which is already changed with refrigerant and lubricant. The component may be added "as is" or as a concentrate, for example in a lubricant for use in the system. Thus systems which have been operating may receive the component or concentrate without the need for a retrofilling procedure or may benefit from a cleaning effect during use cleaned prior to shut-down by addition of the component or concentrate.

Accordingly a preferred method of operating a refrigeration system includes the steps of operating the refrigeration system containing a refrigerant and a lubricant, adding the anti-deposition component to the system as a concentrate, and operating the system further so as to inhibit deposition or remove deposits of unwanted residues.

The amphiphilic component must have an optimum balance of amphiphilicticity and solubility in the circulating refrigerant/lubricant mixture at the dose-rate employed in order to provide an anti-deposition effect sufficient to reduce or avoid the formation of blockages in the refrigeration system. A measure of the amphiphilicity of the component may be obtained by observing the effect of the component in a standard test as hereinafter defined.

In this test, referred to as the "Dispersibility Test" for convenience, a mixture of 3GS mineral oil, available from Suniso, a neopentyl polyol ester and the amphiphilic component is dispersed in 1,1,1,2-tetrafluoroethane (R134a) and the time for full phase separation of the mixture from R134a is recorded. 50% by weight of 3GS mineral oil is mixed with 50% by weight of a pentaerythritol ester sold under the trade name EMKARATE RL (grade 32H) available from ICI to form a test oil mixture (TOM). To this TOM, the amphiphilic component is added at a level of 1% by weight based on the weight of the oil mixture to form a homogeneous mixture. The TOM with the amphiphilic component and liquid R134a are then mixed in a ratio of 100 parts TOM to 100 parts R134a and 1 part anti-deposition component by weight at approximately 20° C. and agitated vigorously to form a dispersion of R134a with the TOM. The time from which agitation ceases to the formation of 2 distinct clear liquid phases is then measured visually. The time for the distinct phases to form provides an indicative measure of the efficacy of the additive in providing an anti-deposition effect, a longer time for the formation of the distinct phases relative to a sample without the component being indicative of greater efficacy. It is preferred in the present invention that the phases separate to form two distinct clear liquid phases only after at least 10 seconds, more preferably 30 seconds and even more preferably after at least 1 minute. Especially preferred are those components that delay separation of the phases for at least 3 minutes and most desirably at least 5 minutes. As a reference, a mixture of TOM and R134a without the anti-deposition component separates almost immediately and in any event in less than 5 seconds. It is an essential requirement of the invention that the component does not precipitate from the test mixture and at the concentration employed in the test, at any point during the test.

The anti-deposition component may be any material which meets the criterion of the Dispersibility Test. The component typically has several moieties within the molecule, at least one of which is oleophilic and one of which has a greater affinity for R134a than the oleophilic moiety and which is referred to as a polar moiety.

The anti-deposition component may be cationic, amphoteric, nonionic or anionic. It is especially preferred that the component be anionic and contain a non-polar part to the molecule.

It is preferred that the component contains, as a polar moiety, an ionisable moiety desirably in ionised form and especially an anionic moiety, or a moiety containing a fluorocarbon group or both an ionisable moiety and a moiety containing a fluorocarbon group. Suitable anionic moieties include sulphate, sulphonate, phosphate and carboxylate and moieties having an active hydrogen, for example anionic fluorosurfactants including compounds available under the ZONYL trade name available from Aldrich. Anionic sulphates and carboxylates are less preferred due to stability and performance reasons. The fluorocarbon group may be any group which contains a carbon atom and a fluorine atom including, by way of example, a hydrocarbyl group wherein at least one hydrogen atom is substituted by a fluorine atom, and optionally all hydrogen atoms have been substituted by fluorine atoms, in other words a group containing exclusively carbon and fluorine atoms for example trifluoromethyl, pentafluoroethyl heptafluoropropyl. Preferably the fluorocarbon group has from 1 to 8 carbon atoms, more preferably from 1 to 6 carbon atoms and especially from 1 to 3 carbon atoms. The fluorocarbon group may be linear or branched. Especially preferred materials include alkyl succinates, for example dioctyl sulphosuccinate and aromatic sulphonic acids and petroleum sulphonates. Ionic species may be employed as salts or preferably in acid form.

Suitable nonionic components include alkyl alkoxylates derived from an alkylene oxide and a moiety derivable from a compound having an active hydrogen atom and an oleophilic moiety, for example a long chain alcohol. Preferred oleophilic moieties include moieties having an aliphatic hydrocarbyl group, for example a hydrocarbyl group having from 6 to 22 carbon atoms, an aromatic hydrocarbyl group and mixtures thereof. Suitable moieties having an active hydrogen atom include an alcohol group, an amine group, a carboxylic group whether derived from an acid, ester or anhydride.

Other suitable nonionic components include esters of polyalkylene glycols and fluorinated polyethers.

Examples of especially preferred anti-deposition components include those listed in Table 1 below and the classes of compounds to which they belong. Particularly preferred examples include dialkylsulphosuccinates and salts thereof, fluoroaliphatic polymeric esters, alkyl aromatic sulphonic acids and salts thereof and comb graft copolymers of methyl methacrylate methacrylic acid and methoxy polyethylene oxide methacrylate and solutions of acrylic graft copolymers, for example.

The anti-deposition component is suitably present in the composition at a level of 0.001 to 5%, preferably 0.001% to 3%, more preferably 0.01 to 3% and especially 0.05 to 1% for example 0.5% by weight by weight of the lubricant. The component is suitably mixed with the lubricant prior to charging to a refrigeration system. A single anti-deposition component or a mixture of such components for example a mixture of an anionic component and a nonionic component may be employed as desired.

It is required that the anti-deposition component be employed at a level at which it remains soluble in the refrigerant/lubricant mixture in the refrigeration system. If the component does not remain soluble at the dose-rate employed, it may itself cause undesirable blockage in the system.

The solubility of the component in the mixture of refrigerant and lubricant will depend on the specific materials employed and also the conditions under which solubility is determined. In the refrigeration system, the evaporation of refrigerant at the exit to the expansion device is likely to present the most severe conditions under which the component must remain soluble due to the low temperature, typically at or around the boiling point of the refrigerant.

Suitably, the level of and type of anti-deposition component is selected so that the component is soluble in a mixture of the refrigerant and lubricant, at a level of 10% by weight of lubricant to the refrigerant/lubricant mixture, to be used at the boiling point of the refrigerant.

Suitable synthetic lubricants which may be employed in the present invention include, alone or in combination, polyol esters, especially neopentyl polyol esters, polyalkylene glycols, polyvinyl ethers and alkyl benzenes. Especially suitable lubricants are polyol esters and/or polyakylene glycols, optionally in combination with alkyl benzenes.

Synthetic lubricants preferred for use in the working fluid compositions of the invention are those selected from the class known as the polyol esters and especially neopentyl polyol esters which have, inter alia, a relatively high level of thermal stability. Suitable neopentyl polyol esters include the esters of pentaerythritol, polypentaerythritols such as di- and tripentaerythritol, trimethylol alkanes such as trimethylol propane, and neopentyl glycol. Such esters may be formed with linear and or branched aliphatic carboxylic acids, such as linear and/or branched alkanoic acids, or esterifiable derivatives thereof, for example anhydrides. A minor proportion of an aliphatic polycarboxylic acid, for example an aliphatic dicarboxylic acid, or an esterifiable derivative thereof may be also used in the synthesis of the ester lubricant in order to increase the viscosity thereof. However, where such an aliphatic polycarboxcylic acid (or esterifiable derivative thereof is employed in the synthesis, it will preferably constitute no more than 50 mole %, more preferably no more than 30 mole %, especially no more than 10 mole % of the total amount of carboxylic acid used in the synthesis. For convenience, the term "carboxylic acid" when employed herein is to be taken to include "esterifiable derivatives" of that acid unless the context clearly precludes this meaning. Usually, the amount of the carboxylic acid(s) used in the synthesis will be sufficient to esterify all of the hydroxyl groups contained in the polyol, but in certain circumstances residual hydroxyl functionality may be acceptable.

A preferred neopentyl polyol ester lubricant is one comprising one or more compounds of the general formula II:

$$R(0C(O)R^1)n \qquad \text{II}$$

wherein

R is a hydrocarbon radical remaining after removing the hydroxyl groups from pentaerythritol, dipenaerythritol, tripentaerythritol, trimethylol ethane, trimethylol propane or neopentyl glycol, or the hydroxyl containing hydrocarbon radical remaining after removing a proportion of the hydroxyl groups from pentaerythritol, dipentaerythritol, tripentaerythritol, trimethylol ethane, trimethylol propane or neopentyl glycol;

Each $R^1$ is, independently, H, a straight chain aliphatic hydrocarbyl group, a branched chain aliphatic hydrocarbyl group, an aliphatic hydrocarbyl group (linear or branched) containing a carboxylic acid or carboxylic acid ester substituent, provided that at least one $R^1$ group is a linear aliphatic hydrocarbyl group or branched aliphatic hydrocarbyl group; and n is an integer.

The aliphatic hydrocarbyl groups specified for $R^1$ above may be substituted, for example by chloro, fluoro and bromo, and/or may include hetero atoms for example oxygen and nitrogen which may be pendant to the carbon chain or part of the carbon chain of the hydrocarbyl group. Preferably, however, the hydrocarbyl groups contain hydrogen, carbon and optionally oxygen for example in the case where $R^1$ is an aliphatic hydrocarbyl group containing a carboxylic acid of carboxylic acid ester substituent. It is especially preferred that the hydrocarbyl group contains only carbon and hydrogen atoms.

The ester lubricants of Formula II may be prepared by reacting the appropriate polyol or mixture of polyols with the appropriate carboxylic acid or mixture of acids. Esterifiable derivatives of the carboxylic acids may also be used in synthesis, such as the acyl halides, anhydrides and lower alkyl esters thereof. Suitable acyl halides are the acyl chlorides and suitable lower alkyl esters are the methyl esters. Aliphatic polycarboxylic acids, or esterifiable derivatives thereof, may also be used in the synthesis of the ester lubricant. Where an aliphatic polycarboxylic acid is used in the synthesis of the ester lubricant, the resulting lubricant will comprise one or more compounds of Formula II in which at least one of the R1 groups is an aliphatic hydrocarbyl group (linear or branched) containing a carboxylic acid or carboxylic acid ester substituent. The ability of polycarboxylic acids to react with two or more alcohol molecules provides a means of increasing the molecular weight of the ester formed and so a means of increasing the viscosity of the lubricant. Examples of such polycarboxylic acids include maleic acid, adipic acid and succinic acid, especially adipic acid. Generally, however, only monocarboxylic acids will be used in the synthesis of ester lubricant, and where polycarboxylic acids are used they will be used together with one or more monocarboxylic acids and will constitute only a minor proportion of the total amount of carboxylic acids used in the synthesis. Where an aliphatic polycarboxylic acid is employed in the synthesis, it will preferably constitute no more than 50 mole %, more preferably no more than 30 mole %, and especially no more than 10 mole% of the total amount of carboxylic acids used in the synthesis, with one or more monocarboxylic acids constituting the remainder.

The amount of the carboxylic acid(s) (or esterifiable derivatives thereof) which is used in the synthesis suitably is sufficient to esterify all of the hydroxyl groups contained in the polyol(s), in which case the resulting lubricant will comprise one or more compounds of Formula II in which R is the hydrocarbon radical remaining after removing the hydroxyl groups from pentaerythritol, dipentaerythritol, tripentaerythritol, trimethylol ethane, trimethylol propane or neopentyl glycol. However, in certain circumstances ester lubricants which comprise residual hydroxyl functionality may be acceptable. Such lubricants comprise one or more ester compounds of Formula II in which R is the hydroxyl containing hydrocarbon radical remaining after removing a proportion of the hydroxyl groups from pentaerythritol, dipentaerythritol, tripenaerythritol, trimethylol ethane, trimethylol propane or neopentyl glycol. Esters containing residual (unreacted) hydroxyl functionality are often termed partial esters, and lubricants containing them may be prepared by utilising an amount of the carboxylic acid or acids which is insufficient to esterify all of the hydroxol groups contained in the polyol or polyols.

The neopentyl polyol ester lubricants may comprise a single compound of Formula II, i.e. the reaction product which is formed between a single polyol and a single monocarboxylic acid. However, the ester lubricant may also comprise a mixed ester composition comprising two or more single compounds of Formula II. Such mixed ester compositions may be prepared by preparing two or more single esters and then blending those esters together. Esters utilising two two or more carboxylic acids in the synthesis of the ester will produce an ester having two or more acids within a single compound. These materials are also suitable for use alone or in combination with other single esters or mixed esters. Thus, different mixed ester compositions, each of which ester has been prepared by utilising two or more polyols and/or two or more carboxylic acids in their synthesis, may also be blended together.

The preferred neopentyl polyol ester lubricants comprise one or more compounds of Formula II in which R is the hydrocarbon radical remaining after removing the hydroxyl groups from pentaerythritol, dipentaethritol, trimethylol propane or neopentyl glycol. Particularly preferred alcohols for the synthesis of the ester are pentaerythritol, dipentaerythritol and trimethylol propane.

Preferably, each $R^1$ in Formula II is, independently, a linear aliphatic hydrocarbyl group or a branched aliphatic hydrocarbyl group.

Preferred linear aliphatic hydrocarbyl groups for $R^1$ are the linear alkyl groups, particularly the $C_{3-12}$ linear alkyl groups, more particularly the $C_{5-10}$ linear alkyl groups and especially the $C_{5-8}$ linear alkyl groups. Examples of suitable linear alkyl groups include n-pentyl, n-hexyl, n-heptyl, n-octyl, n-nonyl and n-decyl. Esters containing such alkyl groups can be prepared by utilising a linear alkanoic acid (or esterifiable derivative thereof) in the synthesis of the ester.

Preferred branched aliphatic hydrocarbyl groups for $R^1$ are the branched alkyl groups, particularly the $C_{4-14}$ branched alkyl groups, more particularly the $C_{6-12}$ branched alkyl groups and especially the $C_{8-10}$ branched alkyl groups. Examples of suitable branched alkyl groups include isopentyl, isohexyl, isoheptyl, isooctyl, isononyl, isodecyl, 2-ethylbutyl, 2-methylhexyl, 2-ethylhexyl, 3,3,5-trimethylhexyl, neopentyl, neoheptyl and neodecyl. Esters containing such alkyl groups can be prepared by utilising a branched alkanoic acid (or esterifiable derivative thereof in the synthesis of the ester.

In a particular preferred embodiment of the present invention, the ester lubricant comprises one or more esters of general Formula III

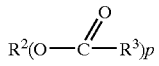

III wherein $R^2$ is the hydrocarbon radical remaining after removing the hydroxyl groups from the pentaerythritol, dipentaerythritol or trimethylol propane;

each $R^3$ is, independently, a linear alkyl group or branched alkyl group; and p is an integer of 3, 4 or 6, wherein one or more of the named polyols, one or more linear alkanoic acids or esterifiable derivatives thereof and optionally one or more branched alkanoic acids, or esterifiable derivatives thereof, are utilised in the synthesis of the ester lubricant.

Preferably, a mixture of two or more linear alkanoic acids, in particular two, or esterifiable derivatives thereof, are utilised in the synthesis of the ester. More preferably, a mixture of one or more linear alkanoic acids, or esterifiable derivatives thereof, and one or more branched alkanoic acids, or esterifiable derivatives thereof, are utilised in the synthesis. Thus, particularly preferred ester lubricants of the invention are mixed ester compositions which comprise a plurality of compounds of Formula III.

Where a mixture of linear and branched alkanoic acids, are utilised in the synthesis with the ester, as is preferred, the linear alkanoic acid(s) preferably constitutes at least 25 mole % e.g. from 25 to 25 mole %, of the total amount of carboxylic acids used. In this way, at least 25 mole % e.g. from 25 to 75 mole % of the hydroxyl groups contained in the polyol or mixture of polyols may be reacted with the said linear alkanoic acid(s).

Ester based lubricants comprising one or more compounds of Formula III provide a particularly good balance between the properties desired of a lubricant and, in particular good balance between the properties desired of a lubricant and, in particular, exhibit good thermal stability, good hydrolytic stability and acceptable solubility and miscibility with the refrigerant. It is particular desirable that the lubricant which is used in a working fluid composition designed to replace the existing compositions based on R-22 and R-502 exhibits good thermal stability.

Preferably, $R^2$ is the hydrocarbon radical remaining after removing the hydroxyl groups from pentaerythritol or dipentaerythritol.

Preferred linear and branched alkyl groups for $R^3$ are those described above in connection with $R^1$ and are derived by utilising the corresponding alkanoic acids, or esterifiable derivatives thereof.

An especially preferred ester based lubricant comprises an ester based lubricant based on pentaerythritol or oligomers thereof or neopentyl glycol with linear and/or branched acids having from 5 to 10 carbon atoms. Examples of suitable lubricants include the EMKARATE RL range of refrigeration lubricants available from ICI in particular grades 22H, 32H and 68H. Esterifiable derivatives of the acids may also be used in the synthesis of the ester.

Suitable polyoxyalkylene glycol lubricants include hydroxyl group initiated polyoxyalkylene glycols, for example ethylene and/or propylene oxide oligomers initiated on mono alcohols for example methanol and butanol, or polyhydric alcohols, for example, pentaerythritol and glycerol. Such polyoxyalkylene glycols may also be end-capped with suitable terminal groups including alkyl, for example methyl groups.

A preferred polyoxyalkylene glycol lubricant has an average molecular weight in the range of from about 150 to about 3000 and comprises one or more compounds of general formula I:

$$A[—O—(CH_2CH(CH_3)O)_1(CH_2CH_2O)_m—Q]_x \qquad \text{I}$$

wherein

A is the residue remaining after removing the hydroxyl groups from a hydroxyl containing organic compound;

Q represents hydrogen, an optionally substituted alkyl, acyl, aralkyl or aryl group;

l and m are independently 0 or an integer provided that at least one of 1 or m is an integer, and x is an integer.

The polyoxyalkylene glycol lubricant may be prepared using conventional techniques that are known to those skilled in the art. Thus, in one method, a hydroxyl containing organic compound is reacted with ethylene oxide and/or propylene oxide to form an ethylene oxide and/or propylene oxide oligomer/polymer containing terminal hydroxyl groups. Optionally, this material may then be etherified to produce a polyoxyalkylene glycol of Formula I. The polyoxyalkylene glycol lubricant which is finally formed may comprise a mixture of such compounds which vary from one another in respect of the degree of polymerisation, i.e. the number of ethylene and/or propylene oxide residues. Moreover, a mixture of alcohols and/or phenols may be used as initiators in the formation of the polyoxyalkylene glycol lubricant, and a mixture of etherifying agents which provide different Q groups may also be used. The molecular weight of a polyoxyalkylene glycol lubricant comprising a mixture of compounds of Formula I will represent the average molecular weight of all the compounds present, so that a given lubricant may contain specific polyoxyalkylene glycols which have a molecular weight outside the range quoted above providing the average molecular weight of all the compounds is within that range.

The moiety A in the polyoxyalkylene glycol of Formula I is the residue remaining after removing the hydroxyl groups from a hydroxyl containing organic compound. It is to be understood that this in no way implies that the moiety A need be produced by removing the hydroxyl group. Such compounds include the mono- and polyhydric alcohols and phenols. Where the hydroxyl containing compound which is used as an initiator in the formation of the polyoxyalkylene glycol is a monohydric alcohol or phenol, A is preferably a hydrocarbyl group and more preferably is an alkyl, aryl, alkaryl or aralkyl group, especially alkyl. Suitably alkyl groups for A may be selected from the straight chain (linear), branched or cyclic alkyl groups. Preferably, A is a $C_{1-15}$ alkyl group, more preferably a $C_{1-12}$, particularly a $C_{1-10}$ and especially the $C_{1-6}$ alkyl groups. The alkyl group may be linear or branched and straight chain $C_{1-6}$ alkyl groups are especially preferred. Specific examples of alkyl groups include methyl, ethyl, n-propyl, isopropyl, n-butyl, isobutyl, sec-butyl, tert-butyl, the various pentyl groups, the various hexyl groups, cyclopentyl, cyclohexyl and the like. An especially preferred alkyl group for A is methyl or n-butyl.

Other suitable hydrocarbyl groups for A are those which remain after removing the hydroxyl group(s) from benzyl alcohol and phenols such as phenol. cresol, nonylphenol, resorcinol and bisphenol A.

Where a polyhydric alcohol is used in the formation of the polyoxyalkylene glycol, A is preferably a hydrocarbon radical. Suitable hydrocarbon radicals for A are those which remain after removing the hydroxyl groups from polyhydric alcohols such as ethylene glycol, propylene glycol, 1,4-butanediol, 1,6-hexanediol, diethylene glycol, dipropylene glycol, neopentyl glycol, cyclohexane dimethanol, glycerol, 1,2,6-hexane triol, trimethylolpropane. pentaerythritol, dipentaerythritol and sorbitol. A particularly preferred hydrocarbon radical for A is that remaining after removing the hydroxyl groups from glycerol.

The moiety Q in the polyoxyalkylene glycol of Formula I is H, an optionally substituted alkyl, aralkyl or aryl group. A preferred optionally substituted aralkyl group for Q is an optionally substituted benzyl group. Preferred optionally substituted aryl groups for Q include phenyl and alkyl substituted phenyl groups. Preferably, Q is an optionally substituted, for example halogen substituted, alkyl group, particularly an optionally substituted $C_{1-12}$ alkyl group and more particularly an optionally substituted $C_{1-4}$ alkyl group. Suitable alkyl groups for Q may be selected from, the straight chain (linear), branched or cyclic alkyl groups especially the linear alkyl groups. Although the alkyl groups for Q may be optionally substituted, they are preferably unsubstituted. Accordingly, particularly preferred alkyl groups for Q are selected from methyl, ethyl, propyl, isopropyl and the various butyl groups. An especially preferred alkyl group for Q is methyl.

The polyoxyalkylene glycol of Formula I may be a polyoxyethylene glycol, a polyoxypropylene glycol or a poly(oxyethylene/oxypropylene) glycol in the latter case, the ethylene oxide and propylene oxide residues may be arranged randomly or in blocks along the polymer chain Preferred polyoxyalkylene glycols are polyoxypropylene glycols and the poly(oxyethylene/oxypropylene) glycols.

The lubricant composition may also comprise one or more of the additives which are conventional in the refrigeration lubricants art. Specific mention may be made of oxidation resistance and thermal stability improvers, corrosion inhibitors, metal deactivators, viscosity index improvers, anti-wear agents and extreme pressure resistance additives. Such additives are well known to those skilled in the art. Where the lubricant is part of a lubricant composition containing one or more additives, such additives may be present in the amounts conventional in the art. Preferably, the cumulative weight of all the additives will not be more than 8%, e.g. 5% of the total weight of the lubricant composition.

Suitable oxidation resistance and thermal stability improvers may be selected from the diphenyl-, dinaphthyl-, and phenylnaphthyl-amines, the phenyl and naphthyl groups of which may be substituted. Specific examples include N,N'-diphenyl phenylenediamine, p-octyldiphenylamine, p,p-dioctyldiphenylamine, N-phenyl-1-naphthyl amine, N-phenyl-2-naphthyl amine. N-(p-dodecyl)-phenyl-2-naphthyl amine, di-1-naphthyl amine, and di-2-naphthyl amine. Other suitable oxidation resistance and thermal stability improvers may be selected from the phenothiazines such as N-alkylphenothiazines, and the hindered phenols such as 6-(t-butyl) phenol, 2,6-di-(t-butyl) phenol, 4-methyl-2,6-di-(t-butyl) phenol and 4,4'-methylenebis(-2,6-di-[t-butyl]phenol).

Suitable cuprous metal deactivators may be selected from imidazole, benzamidazole, 2-mercaptobenzthiazole, 2,5-dimercaptothiadiazole, salicylidine-propylenediamine, pyrazole, benzotriazole, tolutriazole, 2-methylbenzamidazole, 3,5-dimethyl pyrazole, and methylene bis-benzotriazole. Examples of more general deactivators and/or corrosion inhibitors include organic acids and the esters, metal salts and anhydrides thereof, such as N-oleyi-sarcosine, sorbitan monooleate, lead naphthenate, dodecenyl-succinic acid and its partial esters and amides, and 4-nonylphenoxy acetic acid; primary, secondary and tertiary aliphatic and cycloaliphatic amines and amine salts of organic and inorganic acids, such as oil soluble alkylammonium carboxylates; heterocyclic nitrogen containing compounds, such as thiadiazoles, substituted imidazolines, and oxazolines: quinones and anthraquinones; ester and amide derivatices of alkenyl succinic anhydrides or acids, dithiocarbamates, dithiophosphates; and amine salts of alkyl acid phosphates and their derivatives.

Suitable viscosity index improvers include polymethacrylate polymers, copolymers of vinyl pyrrolidone and methacrylates, polybutene polymers, and copolymers of styrene and acrylates.

Examples of suitable anti-wear and extreme pressure resistance agents include sulphurised fatty acids and fatty acid esters, such as sulphurised octyl tallate; sulphurised terpenes; sulphurised olefin; organopolysulphides; organo phosphorous derivatives including amine phosphates, alkyl acid phosphates, dialkyl phosphates, aminedithiophosphates, trialkyl and triaryl phosphorothionates, trialkly and triaryl phosphines, and dialkylphoaphites, e.g. amine salts of phosphoric acid and monohexyl ester, amine salts of dinonylnaphthalene sulphonate, triphenyl phosphate, tripaphthyl phosphate, diphenyl cresyl and dicresyl phenyl phosphates, tricresyl phosphate, naphthyl diphenyl phosphate, triphenylphosphorothionate; dithiocarbonates, such as an antimony dialkyl dithiocarbamate; chlorinated and/or fluorinated hydrocarbons and xanthates.

The invention is now described by way of non-limiting example.

EXAMPLE 1

A series of test mixtures were produced by mixing 10 g of EMKARATE RL (supplied by ICI) Grade 32H with 10 g of 3GS mineral oil available from Suniso and 0.2 g of the anti-deposition component as listed in Table 1 below. This mixture was then added to 20 g R134a and subjected to the Dispersibility Test set out above. The time for the materials to separate was then measured and the results are shown in Table 1.

TABLE 1

| Anti - Depositon Component | Supplier | Separation Time |
|---|---|---|
| SPAN 85 | ICI | 15 s |
| SPAN 80 | ICI | 25 s |
| FC430 | 3M | 90 s |
| FC431 | 3M | 10 s |
| ZONYL FSJ | Aldrich | 30 s |
| ZONYL FSP | Aldrich | 10 s |
| ZONYL FSA | Aldrich | 10 s |
| TRITON X-100 | BDH | 20 s |
| TWEEN 20 | ICI | 10 s |
| TWEEN 60 | ICI | 25 s |
| SURFYNOL SE | Lancaster | 15 s |
| Dioctylsulfosuccinate | Lancaster | >5 mins |
| HYPERMER CG6 | ICI | 10 s |
| TWEEN 80 | ICI | 20 s |
| SPAN 80 | ICI | 10 s |
| SYNPERIONIC 91/6 | ICI | 10 s |
| ATLAS G1284 | ICI | 30 s |
| SYNPERONIC A7 | ICI | 10 s |
| ZONYL FSE | Aldrich | 15 s |
| Dodecylbenzenesulphonic acid | Aldrich | >5 mins |
| Dodecylsulphate | Aldrich | 25 s |
| Lauryl acrylate | Lancaster | 15 s |
| Allyl stearate | Lancaster 20s | 20 s |
| 2-hydroxyhexadecanoic acid | Lancaster | 35 s |

EXAMPLES 2 TO 5 AND COMPARATIVE EXAMPLES A AND B

The effect of various anti-deposition components was tested on a capillary tube test rig in the following "Test Method".

A test rig was set up. The rig had a L'Unite Hermetique compressor (model AZ1330Y) linked to a capillary tube via a line passing through a close-coupled heat exchanger. A return line from the capillary tube, through the close-coupled heat exchanger and back to the compressor completed the loop for the circulating refrigerant composition. The average suction and discharge pressures were respectively 15 and 200 psig. The capillary tube had an internal diameter of 0.65 mm and the tube was 2.2 m long. The ambient temperature was around 20° C. Three way valves were located in the line immediately before and after the capillary tube to facilitate flow measurement.

Nitrogen was passed through the capillary tube at a pressure of 150 psig and the pressure was gradually increased and the time taken for five liters of nitrogen to pass through the capillary tube was measured to equilibrium from which an average flow in liters per minute was recorded. The system was then purged with R-134a and then charged with R-134a to the vapour pressure of the refrigerant. As the lubricant 300 ml of EMKARATE RL 22H polyol ester oil, available from ICI was charged to the compressor. For Comparative Example B and Examples 2 to 5, 500 ppm by weight based on the weight of lubricant of paraffin wax was dosed to the lubricant prior to charging. The paraffin wax was added to act as a blocking material. This level of paraffin wax had been determined to cause blockage by restricting the flow rate by up to 50% over a period of 5 days and the flow rate was at a level of around 50% for a further 5 days.

The anti-deposition component formed a constituent of the oil in Examples 2 to 5, at a level of 1% by weight prior to charging.

The system was operated for a period of around 20 days. The flow of material through the capillary tube was measured once per day until the flow restriction remained about constant or the tube was blocked so that the flow had decreased to less than about 50% of the original value. Between tests, the rig and compressor were cleaned for for reuse in subsequent tests.

For comparative purposes (Comparative Examples A and B), the test rig was operated for over 20 days using only refrigerant and lubricant (Comparative Example A) and then, additionally with wax (Comparative Example B) as set out above. No anti-deposition component was present in these reference runs.

Anti-deposition components as set out in Table 2 were then tested in succession in the test rig and the flow rate through the capillary tube was measured over a period of about 20 days.

The results of these runs are shown below in Table 3 with the reference run being labelled Comparative A and B and the other test runs being referred to as Examples 2 to 5.

The anti-deposition components tested were as follows:

TABLE 2

| EXAMPLE | COMPONENT | CHEMISTRY | SUPPLIER |
|---|---|---|---|
| 2 | FC 430 | Fluorocarbon ester | 3M |
| 3 | SURFYNOL SE | 2,4,7,9-Tetramethyl-5-decyn-4,7-diol | Lancaster |
| 4 | Anionic Surfactant | Dioctylsulfo succinate | Lancaster |
| 5 | Hypermer CG6 | Water/propylene glycol solution of acrylic graft copolymer | ICI |

TABLE 3

| Time | A | B | 2 | 3 | 4 | 5 |
|---|---|---|---|---|---|---|
| 0 | 100.0 | 100.0 | 100.0 | 100.0 | 100.0 | 100.0 |
| 0.5 | | | | 96.7 | | |
| 1 | | 84.7 | 93.9 | 86.2 | 95.2 | 95.4 |
| 1.5 | 101.1 | | | | | |
| 2 | | 82.2 | 87.4 | 88.8 | | |
| 3 | | 63.3 | | 83.1 | | |
| 4 | 87.8 | | | 84.3 | 93.4 | 88.2 |
| 5 | | | 89.0 | | 92.7 | 88.9 |
| 6 | 85.5 | 60.4 | 93.2 | | | 88.5 |
| 7 | 85.2 | 60.7 | 86.6 | 80.0 | 92.4 | 89.6 |
| 8 | 84.6 | 60.1 | 83.5 | 80.0 | 91.9 | |
| 9 | | 60.2 | 77.2 | 81.7 | | |
| 10 | | 58.3 | | | | |
| 11 | 84.8 | | | 76.9 | 91.7 | |
| 12 | 84.6 | | 89.0 | | 91.1 | 82.3 |
| 13 | 85.9 | | 88.8 | | 92.3 | 80.6 |
| 14 | 84.8 | | 86.1 | 74.0 | 92.4 | 78.9 |
| 15 | 85.6 | | 86.6 | 74.3 | 93.3 | 75.1 |
| 16 | | | 85.8 | 75.1 | | |
| 17 | | | | 74.9 | | |
| 18 | 86.3 | | | 73.9 | 94.1 | 80.8 |
| 19 | 85.4 | | 84.1 | | | 81.9 |
| 20 | | | 83.6 | | | |
| 21 | | | | 87.2 | | |
| 22 | | | | 83.2 | | |
| 23 | | | | 74.1 | | |
| 24 | | | | 85.0 | | |

The results as shown in Table 3 illustrate that the various anti-deposition components reduce the level of blockage in the system caused by the paraffin wax and so a high flow rate is retained. In particular, it may be seen that dioctylsulfo succinate and FC 430 reduce the blocking effect of the paraffin wax to such an extent that similar results are obtained as when only the lubricant itself is tested (Comparative A). Furthermore the anti-deposition components are shown to reduce the rate of blockage of the capillary tube as well as the total blockage due to the paraffin wax.

It is a preferred embodiment of the invention that the anti-deposition component is such that, in use, a flow rate of at least 65% and especially at least 75% of the original flow rate is maintained after 20 days when tested in accordance with the test method set out above. Optimally, it is preferred that the component provides a cleaning effect which provides a flow rate in a system to which 500 ppm paraffin wax has been added to a lubricant and refrigerant which is comparable with the flow rate of that system in which the same lubricant and same refrigerant only are circulating, the flow rate being determined in accordance with the test method set out above.

What is claimed is:

1. A refrigeration lubricant composition suitable for use in a refrigeration system with a refrigerant containing a hydrofluorocarbon and/or a hydrochlorofluorocarbon, consisting essentially of a synthetic lubricant consisting essentially of a polyol ester and/or a polyalkylene glycol and an amphiphilic anti-deposition component which is anionic and contains a non-polar part to the molecule which contains a fluorocarbon group.

2. A composition according to claim 1 in which the amphiphilic anti-deposition component is such that in the Dispersibility Test described herein, the phases of R134a and the total oil mixture separate after at least 10 seconds.

3. A composition according to claim 1 or claim 4 in which the anti-deposition component is present at a level of 0.001 to 5% based on the weight of the lubricant.

4. A composition according to claim 1 in which the polyol ester and/or polyalkylene glycol is a compound of the general formula (II):

$$R(OC(O)R^1)_n \quad \text{(II)}$$

wherein R is a hydrocarbon radical remaining after removing the hydroxyl groups from pentaerythritol, dipentaerythritol, tripentaerythritol, trimethylol ethane, trimethylol propane or neopentyl glycol, or the hydroxyl containing hydrocarbon radical remaining after removing a proportion of the hydroxyl groups from pentaerythritol, dipentaerythritol, tripentaerythritol, trimethylol ethane, trimethylol propane or neopentyl glycol; each $R^1$ is, independently, H, a straight chain aliphatic hydrocarbyl group, a branched chain aliphatic hydrocarbyl group, an aliphatic hydrocarbyl group containing a carboxylic acid or carboxylic acid ester substituent, provided that at least one group is a linear aliphatic hydrocarbyl group or branched aliphatic hydrocarbyl group; and n is an integer.

5. A composition according to claim 4 in which the ester comprises an ester of pentaerythritol, dipentaerythritol and/or tri pentaerythritol and each $R^1$ is selected from a straight chain aliphatic hydrocarbyl group and a branched chain aliphatic hydrocarbyl group.

6. A refrigerant composition comprising the refrigeration lubricant composition according to claim 1, and a refrigerant, in which the refrigerant comprises 1,1,1,2-tetrafluoroethane.

7. A refrigerant composition comprising the refrigeration lubricant composition according to claim 1, and a refrigerant, in which the refrigerant comprises a blend of 2 or more hydrofluorocarbon refrigerants.

8. A refrigeration system comprising a compressor, a condenser, an expansion device and an evaporator linked to form a loop in which a refrigerant circulates and is successively condensed and evaporated so as to provide a refrigeration effect the refrigerant comprising a hydrofluorocarbon and/or a hydrochlorofluorocarbon refrigerant, and the system further containing a refrigeration lubricant composition as defined in claim 1.

9. A method of inhibiting the deposition of or removing unwanted residues in a refrigeration system which comprises operating a refrigeration system when charged with a hydrogen-containing refrigerant and a refrigeration lubricant composition as defined in claim 1.

10. A method according to claim 9 including the steps of operating the refrigeration system containing a refrigerant and a lubricant, adding the anti-deposition component to the system, and operating the system further so as to inhibit deposition or remove deposits of unwanted residues.

11. A refrigeration lubricant composition consisting essentially of a synthetic lubricant consisting of a polyol ester and/or a polyalkylene glycol and an amphiphilic anti-deposition component which is an alkyl alkoxylate derived from an alkylene oxide and a moiety derived from a compound having an active hydrogen atom and an oleophilic moiety, an ester of a polyalkylene glycol or a fluorinated polyether.

12. A refrigeration lubricant composition consisting essentially of a synthetic lubricant consisting of a polyol ester and/or a polyalkylene glycol and an amphiphilic anti-deposition component which is a dialkylsulphonsuccinate, a salt thereof, a fluoroaliphatic polymeric ester, a comb graft copolymer of methyl methacrylate/methacrylic acid/methoxy polyethyleneoxide methacrylate, or a solution of an acrylic graft copolymer.

* * * * *